United States Patent [19]

Dewing

[11] 4,245,822

[45] Jan. 20, 1981

[54] PROCESS FOR THE PRODUCTION OF ALUMINIUM

[75] Inventor: Ernest W. Dewing, Kingston, Canada

[73] Assignee: Alcan Research and Development Limited, Montreal, Canada

[21] Appl. No.: 962,630

[22] Filed: Nov. 21, 1978

[30] Foreign Application Priority Data

Nov. 28, 1977 [GB] United Kingdom ..... 49447/77

[51] Int. Cl.[3] ..... F27B 14/14

[52] U.S. Cl. ..... 266/171; 13/23

[58] Field of Search ..... 13/23; 266/171, 176, 266/168, 215

[56] References Cited

U.S. PATENT DOCUMENTS

| | | | |
|---|---|---|---|
| 1,313,274 | 8/1919 | De Barros | 75/11 |
| 2,468,660 | 4/1949 | Gjedebo | 75/80 X |
| 4,099,959 | 7/1978 | Dewing et al. | 75/68 A |
| 4,140,523 | 2/1979 | Haddad | 75/10 A X |

*Primary Examiner*—M. J. Andrews

*Attorney, Agent, or Firm*—Cooper, Dunham, Clark, Griffin & Moran

[57] ABSTRACT

A process for the production of aluminium in two steps:

$$2Al_2O_3+9C=Al_4C_3+6CO \quad \text{(ii)}$$

and $$Al_4C_3+Al_2O_3=6Al+3CO \quad \text{(iii)}$$

Reaction (ii) takes place in a materials addition chamber and reaction (iii) in a high temperature chamber. Slag is circulated between the chambers via conduits by the action of gas generated in reaction (iii) in the conduits. Aluminium production in the high temperature chamber and slag circulation rate are independently controllable by the provision of independent heat sources.

4 Claims, 3 Drawing Figures

PROCESS FOR THE PRODUCTION OF ALUMINIUM

The present invention relates to the production of aluminium by the direct reduction of alumina by carbon.

The direct carbothermic reduction of alumina has been described in the U.S. Pat. Nos. 3,829,961 and 2,974,032, and furthermore the scientific principles involved in the chemistry and thermodynamics of the process are very well understood.

It has long been recognised (U.S. Pat. No. 2,829,961) that the overall reaction involved in the carbothermic reduction of alumina $$Al_2O_3+3C=2Al+3CO \quad \text{(i)}$$

takes place, or can be made to take place, in two steps:

$$2Al_2O_3+9C=Al_4C_3+6CO \quad \text{(ii)}$$

and $$Al_4C_3+Al_2O_3=6Al+3CO \quad \text{(iii)}$$

Both reactions are highly endothermic but the reaction (ii) which leads to the formation of $Al_4C_3$ can be seen, from the available thermodynamic data, to proceed at an appreciably lower temperature rather than the reaction (iii), which leads to conversion of aluminium carbide to aluminium. Due to the lower temperature and lower thermodynamic activity of aluminium at which reaction (ii) may take place, the concentration of fume (in the form of gaseous Al and gaseous $Al_2O$) carried off by the gas from reaction (ii) when carried out at a temperature appropriate to that reaction is much lower than that carried in the gas at a temperature appropriate to reaction (iii); furthermore, the volume of CO from reaction (iii) is only half that from reaction (ii).

Existing data suggests that the energy required for each of the two stages is of the same order of magnitude.

We have already described in U.S. Pat. No. 4,099,959 a process for the production of aluminium metal by the carbothermic reduction of alumina which relies on establishing a circulating stream of molten alumina slag, containing combined carbon, in the form of aluminium carbide or oxycarbide; circulating the stream of molten alumina slag through a low temperature zone maintained at least in part at a temperature at or above that required for reaction of alumina with carbon to form aluminium carbide (reaction (ii)), but below that required for reaction of aluminium carbide with alumina to release Al metal (reaction (iii)) and introducing carbon in this zone; forwarding the stream of molten alumina, now enriched in $Al_4C_3$ as a result of reaction (ii), to a high temperature zone (maintained at least in part at a temperature at or above a temperature required for reaction (iii)); and collecting and removing aluminium metal liberated at said high temperature zone as a result of reaction (iii), the molten alumina slag from the high temperature zone then being forwarded to the same or another low temperature zone. The introduction of alumina to make up the alumina consumed in the process is preferably effected at the high temperature zone.

The product aluminium and at least a major part of the gas evolved in reaction (iii) are preferably separated from the molten slag by gravitational action by allowing them to rise through the molten slag in the high temperature zone so that the product aluminium collects as a supernatant layer on the slag and the evolved gas blows off to a gas exit passage leading to apparatus for fume removal.

The process as described in U.S. Pat. No. 4,099,959 is primarily envisaged as depending upon the introduction of the necessary energy into the system by electrical resistance heating. Current was passed through the stream of molten slag in transit from the low temperature zone and during at least part of its path through the high temperature zone.

The requirements for introduction of heat energy into the system are three-fold (a) to support reaction (ii), (b) to support reaction (iii) and (c) to make up heat losses. The heat requirement (a) may be provided by the sensible heat of the slag as it enters the low temperature zone. If the heat losses in the part of the system between the point of aluminium and gas separation and the low temperature zone can be sufficiently restricted it may be unnecessary to introduce any additional energy into the slag stream during flow through this part of the system since it already has sufficient sensible heat.

One form of apparatus for carrying out the process included one or more materials addition chambers where reaction of alumina with carbon to form aluminium carbide (reaction (ii)) occurred at a relatively low temperature and one or more high temperature chambers for removal of product aluminium and gas evolved in reaction of aluminium carbide with alumina to release Al metal (reaction (iii)), each materials addition chamber being connected to the succeeding high temperature chamber by a forward connecting conduit which led into the high temperature chamber through an upwardly directed portion. Each high temperature chamber led into a succeeding materials addition chamber by a return conduit. Heat input to the system was achieved by electrical resistance heating of the slag and the system was arranged so that this took place primarily in the forward connecting conduit (or each such conduit when the apparatus included a series of materials addition chambers and high temperature chambers). The arrangement ensured that reaction (iii) took place to a substantial extent in the upwardly directed terminal portion of the conduit with the result that the gas released in this part of the system acted as a gas lift pump to propel the stream of slag around the system.

Where the system included only a single materials addition chamber and high temperature chamber (and consequently the forward conduit and return conduit formed parallel electrical connections between the two chambers) it was necessary to dimension these conduits somewhat differently from the conduits in a multichamber system where the connecting conduits are connected electrically in series.

It will be apparent with a system arranged so that major evolution of heat occurs in the forward conduit or conduits that the rate of slag circulation will also be dependent upon the rate of gas evolution in the forward conduit or conduits. Slag circulation rate can only be increased or decreased by increase or decrease of the reaction (iii) gas evolution rate. If other factors are maintained constant, as would be the aim in operation, control of circulation rate could only be achieved by increase or decrease of applied voltage to increase or decrease current flow.

However, when power input is changed, both circulation rate and metal production rate change, but not in the same proportion with the result that the composition of the slag in the system slowly shifts to a new value. This may lead to problems, such as instability of the frozen alumina lining in the conduits. In addition slag flow instabilities may occur because of interaction between the gas evolution and the electrical properties of the system. This could lead to oscillations in the heating current.

In any such arrangement the greater part of the heat energy is liberated in the forward conduit or conduits and the rate of circulation of the slag (which depends on the rate of gas generation in the forward conduit or conduits) is thus closely dependent on the total energy input. This leads to difficulties in the control of the operation of the process.

It is an object of this invention to provide an improvement in the process which allows the slag circulation rate to be controlled independently of the total input of heat energy into the system so as to allow, for example, the input of heat energy to be decreased or increased without change of the slag circulation rate or, conversely, to allow the slag circulation rate to be decreased or increased without corresponding change of the total heat energy input to the system.

This is achieved in accordance with the present invention by providing an independent heating system in each of the high temperature chambers to provide a part, preferably a major part, of the heat energy for driving reaction (iii) and a separate, independently controllable resistance heating system for heating the slag flowing through one or more of the forward and/or return conduits for driving reaction (iii) with consequential release of gas in such conduit for promoting circulation of slag. In this revised system it is contemplated that reaction (iii) may take place not only in the or each high temperature chamber but also either in the forward conduit or the return conduit associated with each high temperature chamber or in some instances advantageously in both such conduits, to promote the circulation of slag around the system at a desired rate.

An additional independent heating system can be introduced into each materials addition chamber. The total heat input to the system can thus be increased or decreased by control of the other heating system or systems employed to provide energy to drive reaction (iii) in each high temperature chamber, and where appropriate, reaction (ii) in each materials addition chamber without substantial effect on the rate of slag circulation.

In one system according to the invention the apparatus employed includes one or more materials addition chambers and a corresponding number of high temperature chambers, each chamber being provided with its own power source and with at least two electrodes spaced therein for generation of heat energy in such chamber. In this way, the heat supply in each chamber can be independently controlled. Separate power sources are connected between electrodes arranged to pass current through the slag in the forward conduit or conduits and/or the return conduit or conduits so as to cause reaction (iii) to occur to the extent necessary to provide the desired, controlled gas-lift pump effect for circulating the slag around the closed circuit provided by the chambers and their connecting forward and return conduits. Conveniently, the separate power source for passage of current through the conduit or conduits of each pair of chambers can be connected between electrodes positioned in the respective chambers and forming elements of electrical resistance heating systems in such chambers.

Efficient electrical resistance heating of the contents of the chambers involves providing some restriction in the current path between the electrodes positioned within them.

It is possible to conceive other means for independently heating the molten slag in the chambers. Thus, in place of electrical resistance heating, the contents of the materials addition chamber or chambers and/or the high temperature chamber or chambers might be heated by the use of plasma guns.

With this arrangement, whereby heat is independently generated in the materials addition and high temperature chambers and in the conduits to produce a controlled gas-lift pump effect therein, it is possible to control the temperature and compositions of the contents of the chambers to desired values, and hence to make possible the establishment and maintenance of optimum control of the process.

While it is possible to contemplate a system of this type in which heat is not generated in the materials addition chamber or chambers, the employment of an independent heating system in such chamber or chambers gives greater operational flexibility to the system.

It should be remarked that in most instances the conduits consist of a frozen layer of alumina maintained within an outer steel shell, which is continuously cooled, preferably by water sprays. The thickness and disposition of this frozen layer of alumina is very dependent upon the rate of circulation and the temperature of the slag in the respective conduits so that independent control of the slag circulation rate permits control of the frozen alumina layer to some extent without excessive change of the metal production rate of the system.

The principles of the invention are equally applicable to the control of a 2-chamber system where the return conduit from the high temperature chamber returns slag to the same materials addition chamber, from which the high temperature chamber received slag via the forward conduit and to the control of a multichamber system where the slag from each high temperature chamber is forwarded to a succeeding materials addition chamber in a system of alternate materials addition chambers and high temperature chambers connected in a closed circuit by forward conduits and return conduits.

While a 2-chamber system is satisfactory for working the process on a small scale, for large scale working it is preferred to employ a multi-chamber system incorporating a series of at least two materials addition chambers alternating with high temperature chambers.

The accompanying drawings illustrate diagrammatically apparatus for putting the present invention into practice. In the drawings.

Figure 1:
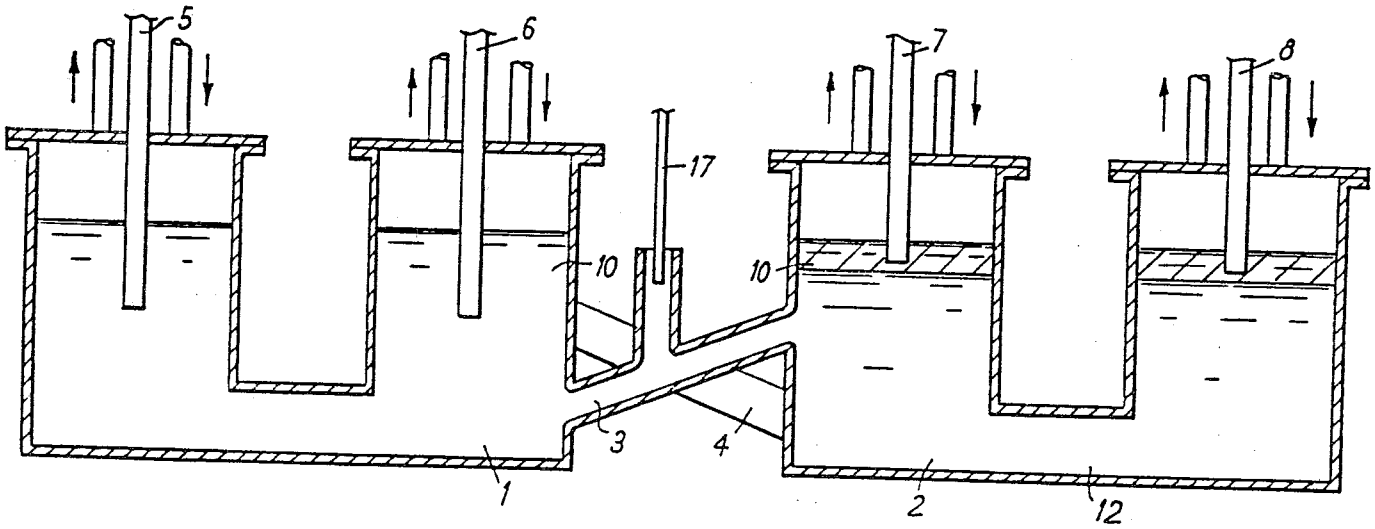
FIG. 1 is a side view of a 2-chamber apparatus.

In the apparatus of FIG. 1 the molten alumina slag is circulated through a system comprising a materials addition chamber 1 and a high temperature chamber 2, connected to each other by a forward conduit 3 and a return conduit 4. Both the forward conduit 3 and return conduit 4 lead upwardly in the direction of slag flow.

Chamber 1 is provided with electrodes 5 and 6 and with ducts for the introduction of carbon feed and for leading away the evolved carbon monoxide.

Chamber 2 is provided with a pair of electrodes 7, 8 which are preferably located in relatively cool side wells (not shown) in which they are in contact with a layer of product Al, which is saturated with $Al_4C_3$, so that the $Al/Al_4C_3$ layer forms liquid electrodes in contact with the slag. Both chambers 1 and 2 therefore have two separate zones 10 in which the electrodes are respectively located for the passage of current through the body of the molten slag in the lower part of each chamber. It will be appreciated that gas outlet ducts are provided above the molten slag in both zones 10 in each chamber. Make-up alumina feed is supplied at some point in the system, preferably at the zones 10 in chamber 2. In a preferable procedure metal is tapped alternately from each collection zone with alumina being fed to the zone that is next to be tapped so as to lower the carbon content of the metal.

Figure 2:
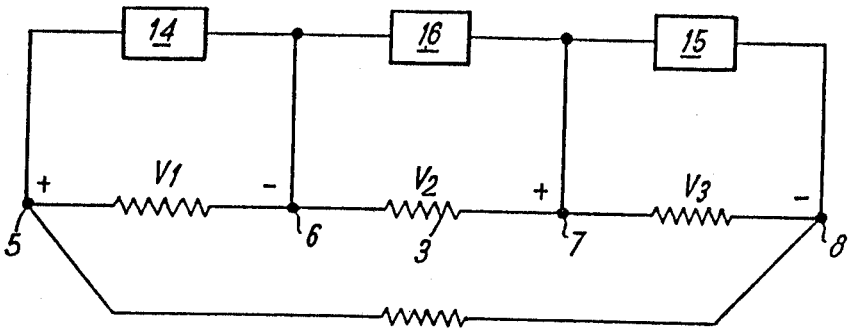
FIG. 2 is a diagram of the connection of the power sources.

FIG. 2 shows diagrammatically the connection of separate variable power sources 14, 15, 16. Source 14 is connected between electrodes 5, 6 and provides the energy required to drive reaction (ii); source 15 is connected between electrodes 7 and 8 and provides part, usually a major part, of the energy required to drive reaction (iii), and source 16 is connected between electrodes 6 and 7 to provide sufficient heat energy in the conduits 3 and 4 so as to cause reaction (iii) to occur therein and so generate the slag circulating gas.

One or more separate electrodes, such as electrode 17 (FIG. 1), may be provided for power source 16, positioned for the passage of current along either or both conduits 3 and 4 to generate gas therein.

In operation molten slag enters the upper part of the chamber 1 (a materials addition chamber) and immediately encounters and reacts with fresh carbon feed, so that it is immediately chilled by loss of heat through reaction with carbon in reaction (ii). The major evolution of carbon monoxide in chamber 1 is therefore at or near the surface of the slag, although gas evolution will continue until carbon feed particles are consumed. Circulation of slag in chamber 1 results partly from cooling slag descending, and thermal stirring arising from the reheating effect of the current passing between electrodes 5 and 6, but mostly as a result of the circulation effected by the lifting action of the gas in forward conduit 3. Both chambers 1 and 2 are shaped so that there is a restricted passage 12 between the zones 10 so that the major release of heat energy is at the bottom of the chamber.

Figure 3:
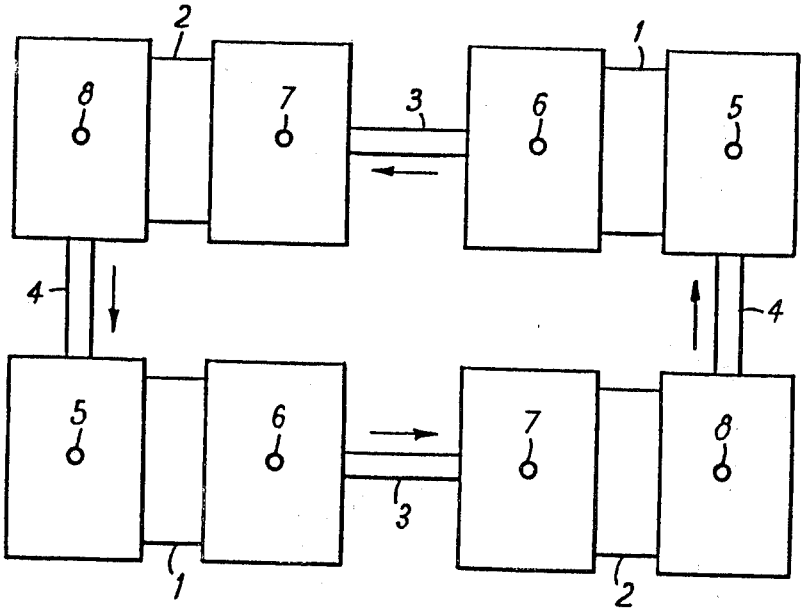
FIG. 3 is a diagrammatic plan view of a 4-chamber apparatus.

In the apparatus of FIG. 3 corresponding parts are identified by the same reference numerals as in FIG. 1. Separate power sources are arranged between each electrode 7 and the electrode 8 in the same chamber 2 and also between each electrode 5 and electrode 6 in the same chamber 1. To control the rate of circulation of slag additional power sources are provided across at least one of the ducts 3, i.e. between one or both of the adjacent pairs of electrodes 6 and 7. Since the circulation must be the same throughout the loop one such power source is in principle sufficient but to secure optimum operation two such power sources may be desirable.

I claim:

1. Apparatus for the production of aluminium metal by the direct reduction of alumina by carbon comprising one or more materials addition chambers where reaction of alumina with carbon to form aluminium carbide (reaction (ii)) occurs at a relatively low temperature and one or more high temperature chambers for removal of product aluminium and gas envolved in reaction of aluminium carbide with alumina to release Al metal (reaction (iii)), each materials addition chamber being connected to the succeeding high temperature chamber by a forward connecting conduit which leads into the high temperature chamber through an upwardly directed portion, and each high temperature chamber leading into a succeeding materials addition chamber by a return conduit, wherein there is provided an independent heating system in each of the high temperature chambers to provide a part, preferably a major part, of the heat energy for driving reaction (iii) and a separate, independently controllable resistance heating system for heating the slag flowing through one or more of the forward and/or return conduits for driving reaction (iii) with consequential release of gas in such conduit for promoting circulation of slag.

2. Apparatus as claimed in claim 1 wherein an additional independent heating system is introduced into the or each material addition chamber.

3. Apparatus as claimed in claim 2 wherein the or each high temperature chamber and the or each materials addition chamber is provided with its own power source and with at least two electrodes spaced therein for generation of heat energy in such chamber.

4. Apparatus as claimed in claim 3 wherein the separate, independently controllable resistance heating system for heating the slag in at least one of the conduits comprises a separate power source connected to respective members of the said pairs of electrodes in the high temperature chamber and the materials addition chamber between which the respective conduit runs.

* * * * *